US007255180B2

(12) United States Patent
Beato et al.

(10) Patent No.: US 7,255,180 B2
(45) Date of Patent: Aug. 14, 2007

(54) MODULAR DRILL SYSTEM REQUIRING LIMITED FIELD ASSEMBLY AND LIMITED EQUIPMENT SUPPORT

(75) Inventors: Christopher Louis Beato, Missouri City, TX (US); Joop Roodenburg, Delft (NL)

(73) Assignees: Drillmar, Inc., Houston, TX (US); Itrec B.V., Schiedam (NL)

( * ) Notice: Subject to any disclaimer, the term of this patent is extended or adjusted under 35 U.S.C. 154(b) by 0 days.

(21) Appl. No.: 11/119,287

(22) Filed: Apr. 29, 2005

(65) Prior Publication Data

US 2005/0241823 A1 Nov. 3, 2005

Related U.S. Application Data

(60) Provisional application No. 60/567,660, filed on May 3, 2004.

(51) Int. Cl.
*E21B 7/12* (2006.01)

(52) U.S. Cl. ..... 175/5; 175/6; 175/7; 175/8; 175/9; 175/10; 173/28

(58) Field of Classification Search ..... 166/378–380; 173/1, 28, 184, 186; 175/5–10
See application file for complete search history.

(56) References Cited

U.S. PATENT DOCUMENTS 4,269,395 A * 5/1981 Newman et al. ..... 254/386
4,371,041 A * 2/1983 Becker et al. ..... 173/28
4,582,205 A * 4/1986 Berger et al. ..... 212/175
4,666,340 A * 5/1987 Cox ..... 405/204
4,899,832 A * 2/1990 Bierscheid, Jr. ..... 173/187
5,741,089 A * 4/1998 Gallaher et al. ..... 405/196
6,533,045 B1 * 3/2003 Cooper ..... 173/28
6,554,075 B2 * 4/2003 Fikes et al. ..... 166/379
2002/0166698 A1 * 11/2002 Beato et al. ..... 175/7

* cited by examiner

*Primary Examiner*—F. Zeender
*Assistant Examiner*—Christopher Buchanan
(74) *Attorney, Agent, or Firm*—Buskop Law Group, PC; Wendy Buskop

(57) ABSTRACT

A modular transfigurable drilling rig comprises one or more transfigurable containers with drilling equipment to form an operational drilling rig. The transfigurable containers include a first and second load bearing support and a load bearing bottom disposed between the first and second load bearing supports, thereby forming a space. The container includes drilling equipment rotatably attached to the load bearing supports or the load bearing bottom. The drilling equipment is disposed within the space. The drilling rig further includes one or more connectors adapted to engage at least two transfigurable containers together. The drilling rig further includes piping adapted to connect the drilling equipment together, cabling adapted to provide communication between the drilling equipment, and a power source connected to the drilling equipment, wherein the power source is adapted to provide power to the drilling equipment.

21 Claims, 13 Drawing Sheets

MODULAR DRILL SYSTEM REQUIRING LIMITED FIELD ASSEMBLY AND LIMITED EQUIPMENT SUPPORT

CROSS REFERENCE TO RELATED APPLICATIONS

The present application claims priority to the co-pending provisional patent application Ser. No. 60/567,660, entitled "Transfigurable Shipping Container for Drilling Equipment and filed on May 3, 2004.

FIELD

The present embodiments relate generally to modular transfigurable drilling rigs shipped and constructed from transfigurable shipping container.

BACKGROUND

A need exists for a system to provide a standardized transfigurable container system because shipping non-standard containers is expensive and difficult.

A need exists for a modular drilling rig system and method that provides a drilling rig that can be easily assembled or "unfolded" on-site in order to reduce labor need, time, and expense.

A need exists for a drilling rig that has less impact on the ground cover or foliage when being transported. A need also exists for less impact on the ground when the drilling rig is set up and in use.

A need also exists for a drilling rig that can be used as a land drilling rig and by assembling the components in a different manner can also be used as an offshore drilling rig.

The present embodiments meet these needs.

BRIEF DESCRIPTION OF THE DRAWINGS

The detailed description will be better understood in conjunction with the accompanying drawings as follows.

Figure 1:
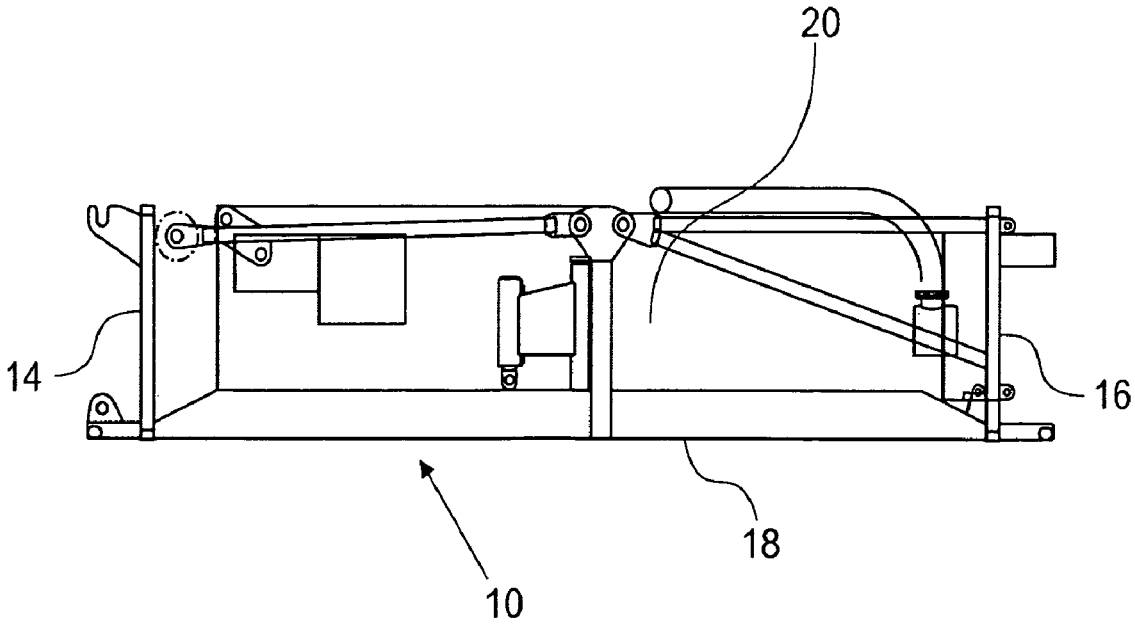
FIG. 1 depicts a side view of an embodiment of a transfigurable container.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The embodied drilling rigs utilize components that can be handled and transported like a container increases the safety. Container transport is done using standardized and automated equipment requiring less hands-on work compared to transporting non standardized equipment. The transfigurable containers provide a restricted maximum weight of containers that makes the containers easy to handle and transport. These benefits lead to a decreased chance of accidents happening during transport and rig-up/rig-down of the drilling rig.

The embodied drilling rigs save the environment by reducing the number of vessels that are required to ship a drilling rig to different locations around the world. The embodied drilling rigs reduce the amount of environmental impact on the earth when being transported by truck, train or other land transportation device. The reduction is accomplished by reducing the space required to transport the standard sized devices. Once the rig has reached a drilling site the surface area that is needed to setup and operate the drill rig is less than a comparable drilling rig not using the method. The reduction in area that must be cleared of trees is approximately 1200 m2 versus approximately 2000 m2 on a comparable conventional drilling rig.

The amount of area that must be cleared on the path to the drilling site is considerably less with a comparable drilling rig. Since the individual weight of the transfigurable containers is less compared with a normal drilling rig the load on the road is less severe. This enables easier transportation across less developed roads and makes the drilling rig easier to be used in less developed countries.

Since the embodied drilling rigs reduce the number of vessels needed to transport a drilling rig, the drilling rigs provide a reduction of fuel usage; a benefit to both cost and the environment. For example, a common sized drilling rig can be transported with seventeen containers. Other drilling rigs of a comparable size often cannot be broken down into container sized packages of less than seventeen. Usually the drilling rigs of a comparable size require containers and shipping parts doubling and tripling the number used with the embodied methods.

An embodiment of the transfigurable container of drilling equipment allows for two or more two pieces of drilling equipment with associated load bearing devices to be attached together using connectors, preferably pivotable connectors. When pivotably connected together, the drilling equipment modules are transformable between an initial shipping container size and shape and a second size and shape. For example, the shipping container can be formed into a rectangular shape when transported and transformed into a non-rectangular shape when in operation. The ability to transform readily between these two sizes and shapes provides an operational drilling structure that can easily be transported and then erected on different locations and in different shapes depending on the operational demands.

With reference to the figures, FIG. 1 examples attaching the drilling equipment to either a load bearing support or a load bearing bottom with telescoping, rotatable connectors or with pivotable, rotatable connectors. The transfigurable container (10) can be a component of a modular drilling rig. The transfigurable container (10) can include a first and second load support (14 and 16) and a load bearing bottom (18). The first and second load bearing supports (14 and 16) can be positioned to form a mast or a derrick. The load bearing bottom (18) is located between the first and second load bearing supports (14 and 16), thereby forming a space (20). The load bearing bottom (18) can have a lattice construction or be a load-bearing plate.

A transfigurable container (10) can be attached to the first load bearing support (14), the second load bearing support (16), or the load bearing bottom (18). The drilling equipment can be attached to either load bearing support (14 and 16) or load bearing bottom (18) using telescoping, rotatable connectors or pivotable, rotatable connectors, sliding connectors, or non-rotating telescoping connectors.

Figure 2:
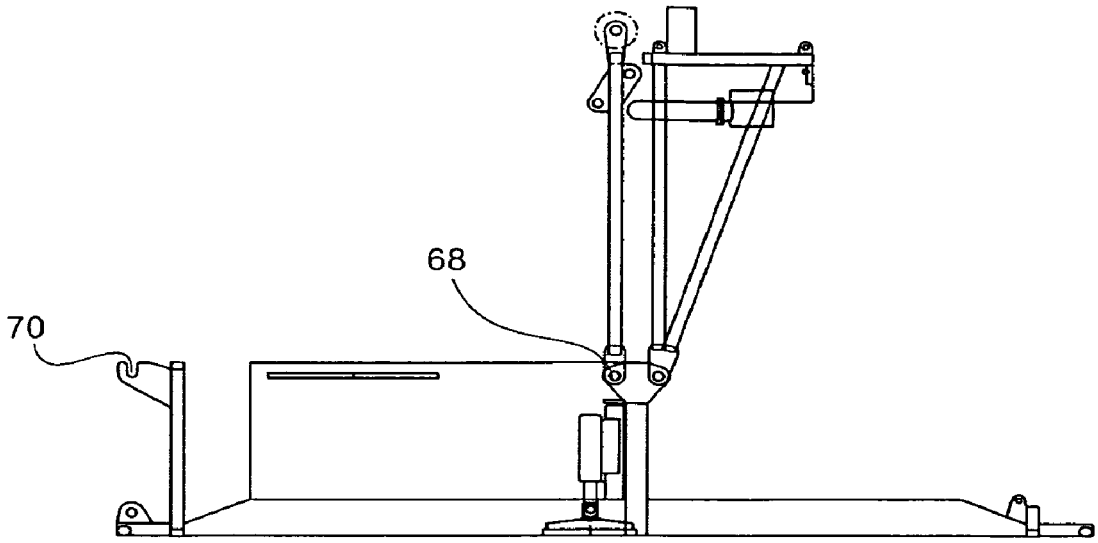
FIG. 2 depicts a side view of an embodiment of an unfolded transfigurable container.
Figure 3:
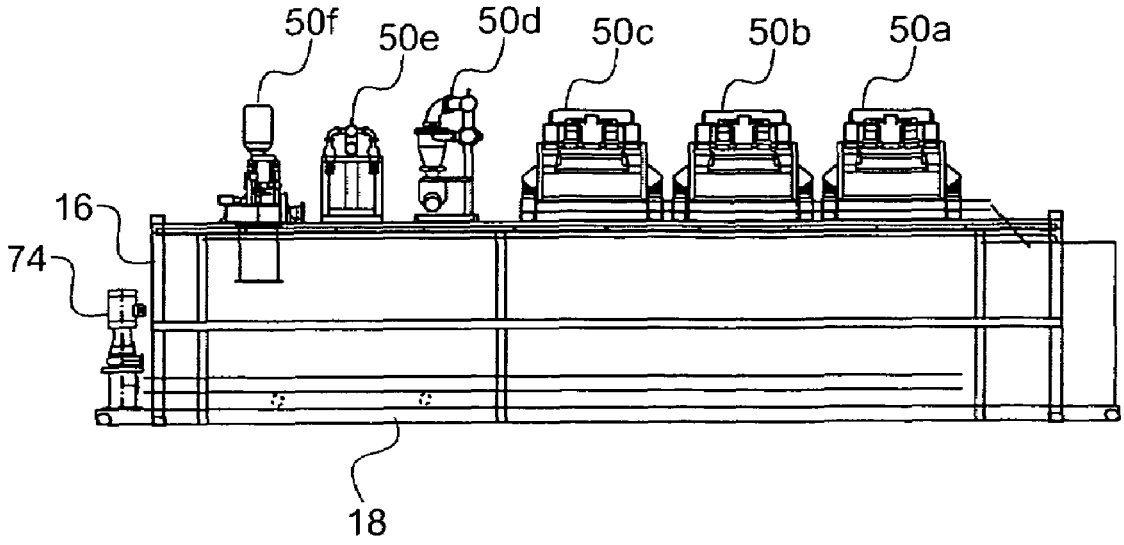
FIG. 3 depicts a side view of an embodiment of a transfigurable container acting as a support to drilling equipment.

FIG. 2 depicts a side view of an unfolded transfigurable container. FIG. 3 shows examples of drilling equipment attached to the loading bearing structure. A rotatable coupling (68) can be used between the drilling equipment. A rotatable coupling (70) can be between the load supports. A rotatable coupling (not shown) can be used between one of the load-bearing supports and the load bearing bottom.

FIG. 3 depicts an embodiment of a device for elevating the drilling equipment (74) above one of the load bearing supports or load bearing bottom. In particular, FIG. 3 examples the second load support (16) and the load bearing bottom (18) supporting various pieces of solids control equipment (50*a*, 50*b*, 50*c*, 50*d*, 50*e*, and 50*f*). In an alternative embodiment, a device for elevating the drilling equipment (74) can be used rather than a cranage device.

The drilling equipment is preferably located within the space between the first and second load bearing supports. The drilling equipment can be attached together and movable from the space to create an operational position outside of the transfigurable container.

The space inside the container can be used for multiple uses depending on the operational status. For example, during transport, the solids control equipment can be inside the solids or mud storage tank. The drilling equipment comprises mud processing equipment of a shaker and a mud storage tank. When drilling operations commence, the solids control equipment is outside the solids or mud storage tank. The solids or mud storage tank is then filled with solids, fluids or mud. The double use of solids or mud storage tank is beneficial because the number of containers needed to transport the drilling equipment is further reduced.

Figure 4:
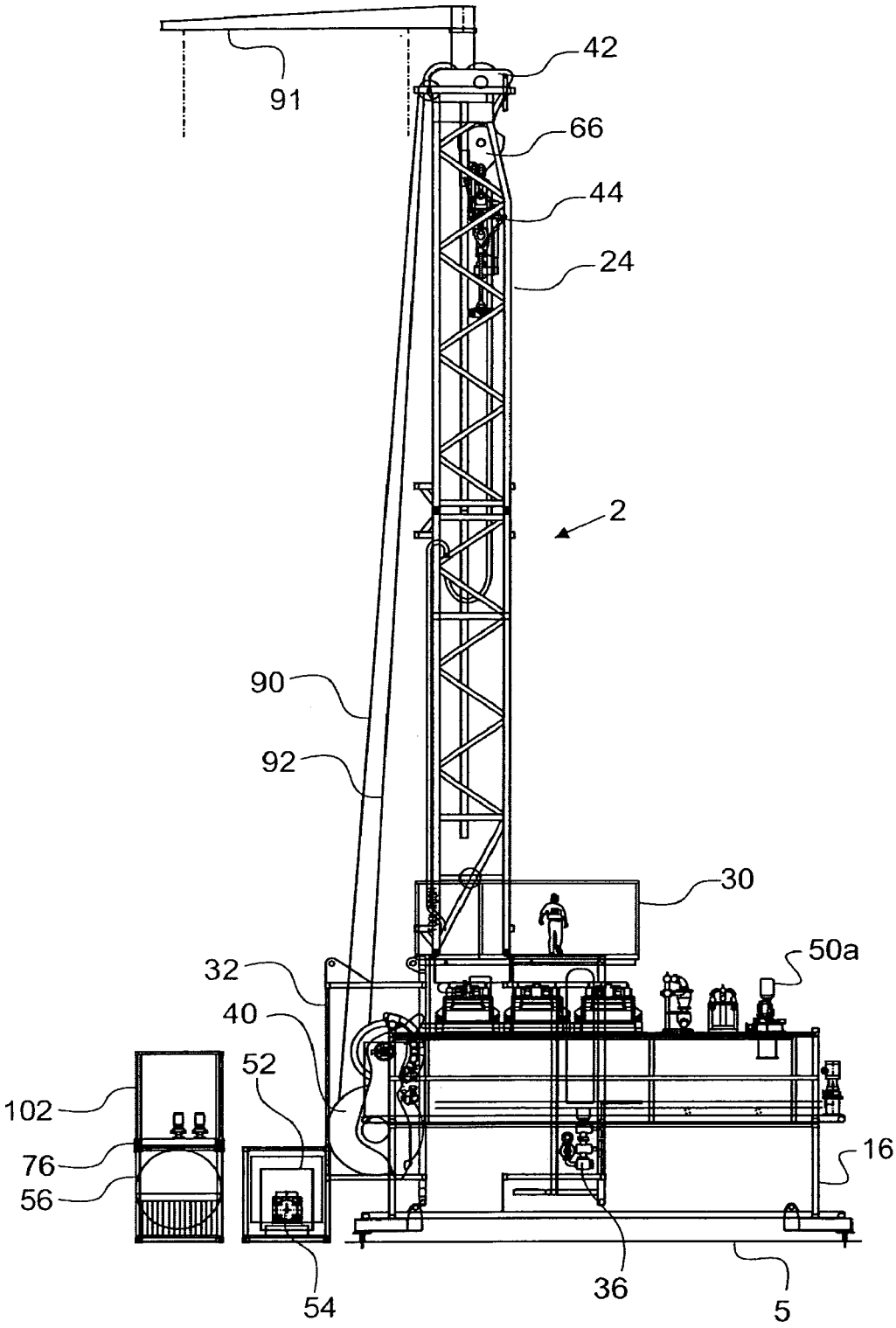
FIG. 4 examples a partial side view of an erected drilling rig made from a transfigurable container.

FIG. 4 examples the drilling equipment (2) erected from the transfigurable container in the offshore embodiment. The drilling equipment (2) can include a mast (24), a control cabin (30), a drawworks module (32), a choke and kill manifold (36), active mud tank (102), and a BOP control unit (not shown). Other types of drilling equipment include a winch (40), a crown block (42), a top drive (44), a rotary table (not shown), piece of solids control equipment (50*a*), a second load support (16), a power source (52), a hydraulic power unit (54), a tank (56), electrical control equipment, a pipe rack, a crane (91), a traveling block (66), a container connector (76) and combinations thereof. The drawworks (32) are connected to the top drive by means of cables or wires (90 and 92). The drilling equipment (2) can further include a deck or supporting structure (5) of an offshore platform.

Figure 5:
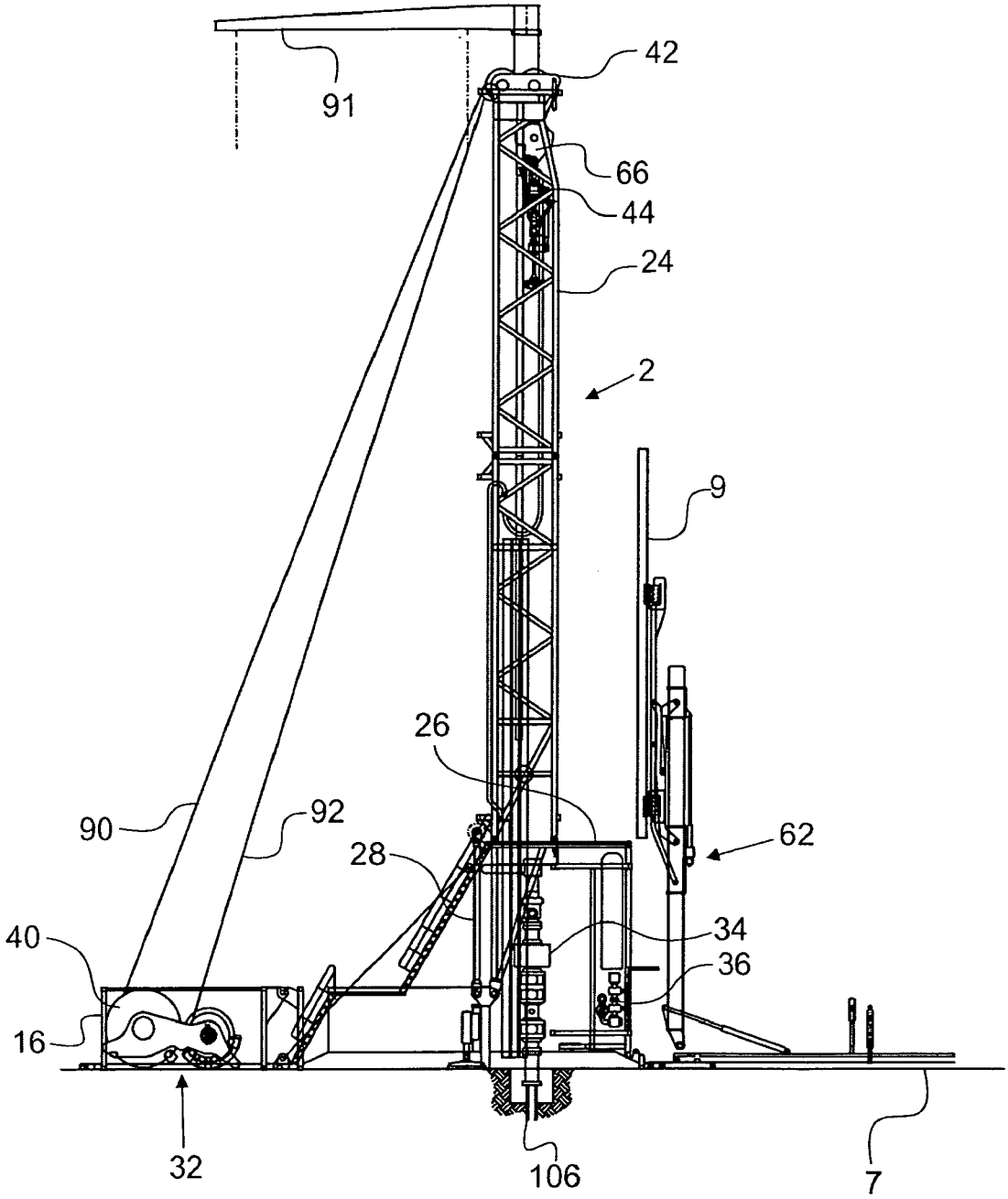
FIG. 5 examples a partial side view of an erected rig made from a transfigurable container.

FIG. 5 examples the drilling equipment (2) erected from the transfigurable container in a land embodiment. The drilling equipment (2) can include a casing (9), a mast (24), a drill floor (26), a mast substructure (28), a drawworks (32), a blow out preventer (BOP) (34), a choke and kill manifold (36), well head (106), and a BOP control unit (not shown). Other examples of drilling equipment include a winch (40), a second load support (16), a crown block (42), associated cables or wires (90 and 92), a top drive (44), a rotary table, electrical control equipment, a pipe rack, pipe handling equipment (62), a crane (91), a traveling block (66) and combinations thereof. The modular drilling rig (2) is supported by ground (7).

Figure 6:
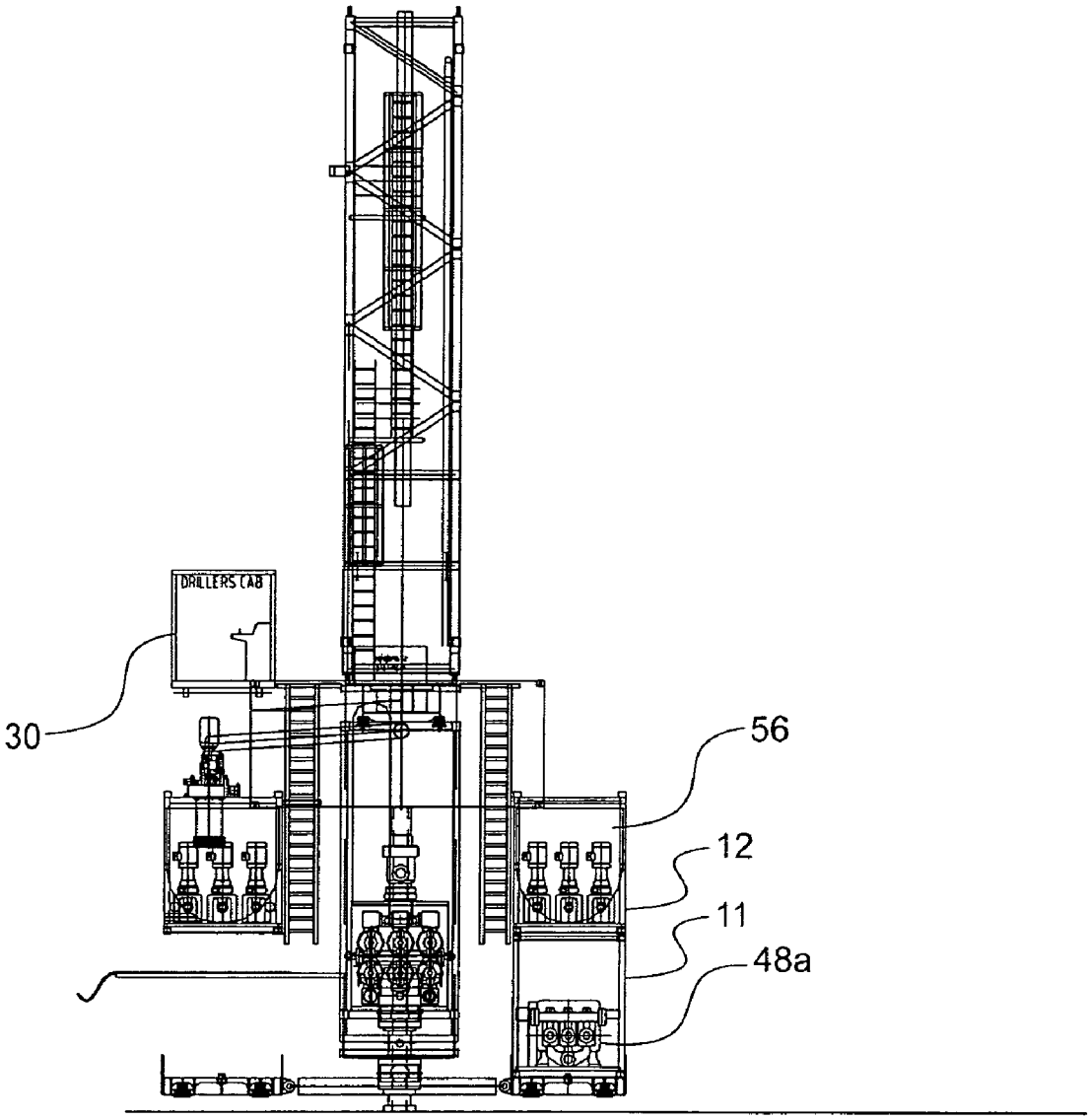
FIG. 6 depicts a partial side view of the erected drilling rig shown in FIG. 5.

FIG. 6 examples drilling equipment that can be included inside of a transfigurable container (11). For example, FIG. 6 shows a control cabin (30), a mud pump (48*a*), a mud tank (56), electrical control equipment, a pipe rack, pipe handling equipment and combinations thereof. The shipping containers can be assembled to create a mast or derrick. A second transfigurable container (12) can be stacked on the first transfigurable container (11) to reduce the footprint of the drilling equipment.

Transfigurable containers for the drilling equipment are transformed to form a portion of an operable drilling rig or standardized shipping containers. The transfigurable containers can be compliant with ISO standards.

Typical sizes for standardized shipping containers include overall lengths ranging from about 8 feet to about 64 feet, overall widths ranging from about 2 feet to about 15 feet, and overall heights ranging from about 2 feet to about 15 feet. An example dimension for a transfigurable container is an overall width of 8 feet, an overall height of 9.5 feet, and an overall length of 45 feet, 40 feet, or 20 feet.

Figure 7:
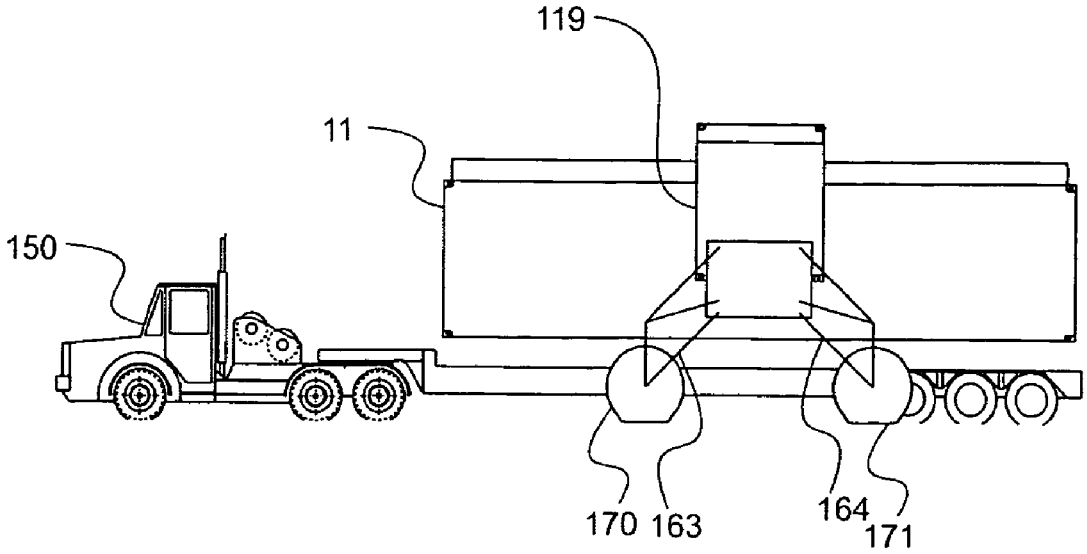
FIG. 7 depicts a side view of a straddle carrier usable with the embodied systems.

FIG. 7 examples how a containerized straddle carrier can fold inside a transfigurable shipping container. The transfigurable shipping containers can include containerized straddle carriers (119) that are adapted to fold inside a standard shipping container. The containerized straddle carrier (119) with a transfigurable container (11) can be transported by a truck (150). FIG. 7 depicts the truck (150), but only two wheels (170 and 171) and two frames (163 and 164) associated with containerized straddle carrier (119) are shown.

Another embodiment is a modular transfigurable drilling rig. The drilling rig can be configured as an offshore oil or natural gas drilling rig or as a land-based oil or natural gas drilling rig. The drilling rigs can be configured for use on a semisubmersible, a tension leg platform, a jack up platform, or another floating vessel. The drilling rigs can be configured for use on a fixed offshore platform, such as a gravity based platform, compliant tower or any other offshore platform that is standing on the seafloor. The modular transfigurable drilling rig can be made from numerous transfigurable containers for drilling equipment.

The standardized transfigurable containers can be stacked on skid beams to present a small footprint. Alternatively, the transfigurable containers can be stacked on top of each other to present a very small footprint. The small footprint is useful for offshore platforms and jungle pads.

Figure 8:
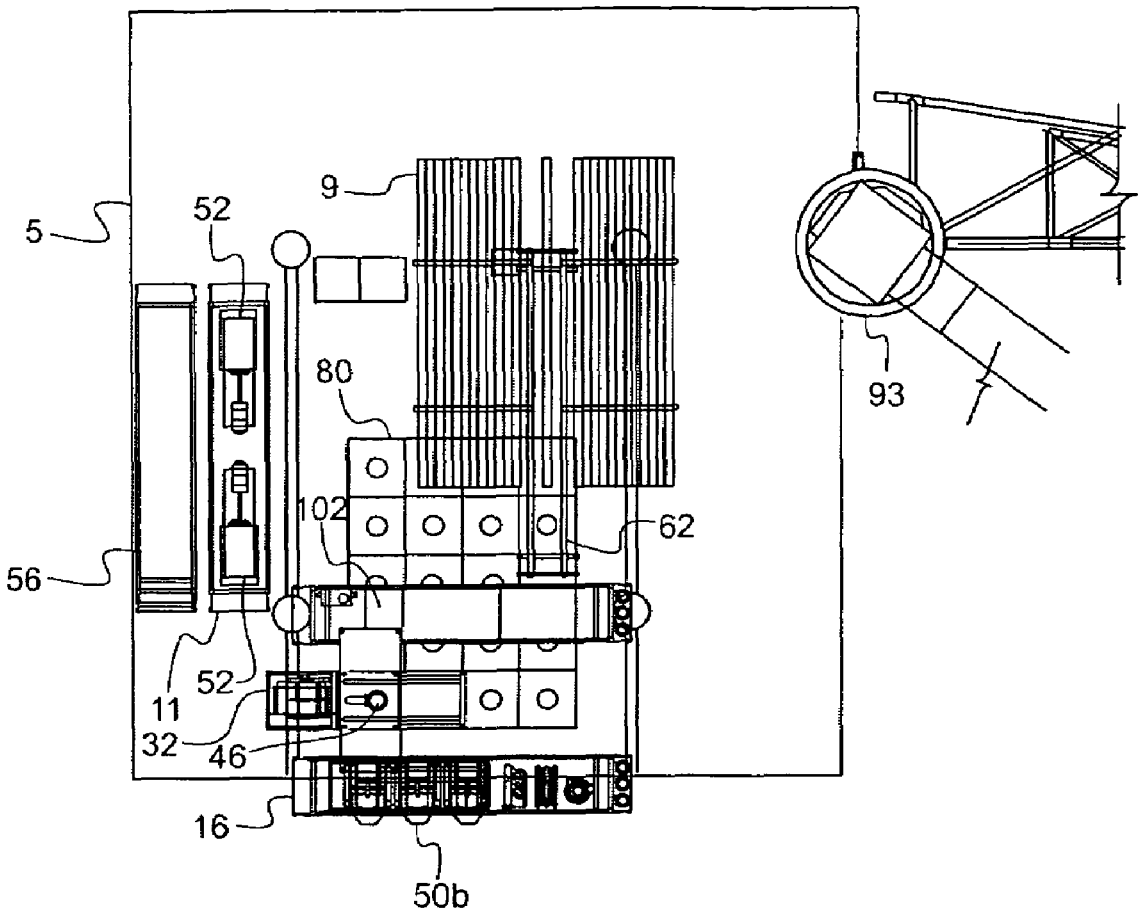
FIG. 8 depicts a top view of an embodiment of a modular drilling rig.

FIG. 8 depicts a top view of an embodiment of a modular drilling rig. FIG. 8 depicts an example of the transfigurable container (11) to other pieces of equipment on the drilling rig. As examples, FIG. 8 examples locations of the drawworks (32), a rotary table (46), a piece of solids control equipment (50*b*), a power source (52, two are shown), a tank (56), pipe handling equipment (62), with casing (9), piping (80), a mud tank (102) and a second load support (16). The equipment is supported by a drilling rig (floating or fixed) (5) on which a platform crane (93) can be present. The transfigurable containers can be lifted on board the drilling rigs using the cranes available on the drilling rigs. The transfigurable containers (11) connect to form an operational modular drilling rig. The modular transfigurable drilling rigs connect one or more container connectors adapted to engage two or more of the transfigurable containers together.

The container connectors can be a load bearing device or a non-load bearing device. Examples of the container connectors used as a load bearing device include pins, hydraulic clamps, mechanical clamps, threaded connectors, male receptacles, female receptacles, and combinations thereof. Examples of the container connectors used as a non-load bearing device include threaded connectors, plugs, hydraulic clamps, mechanical clamps, pins, male and female receptacles, and combinations thereof.

Piping can be used to connect the drilling equipment together. Cabling can be used with the drilling rig provides communication and/or electrical power between the drilling equipment. A power source is typically connected to the drilling equipment to provide power to the drilling equipment.

Figure 9:
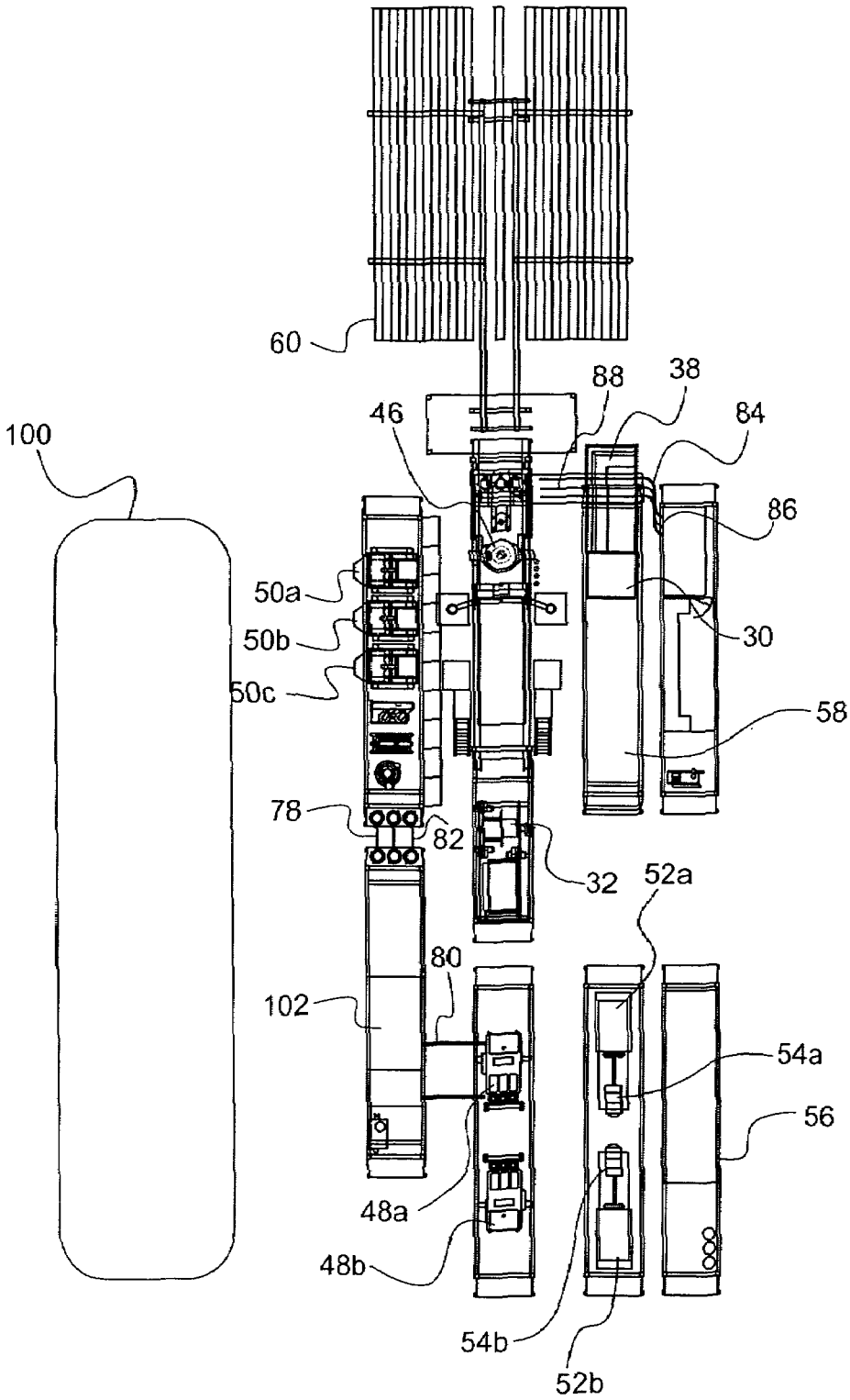
FIG. 9 depicts a top view of an embodiment of a modular drilling rig.

FIG. 9 depicts a top view of a constructed modular rig using the transfigurable containers and the embodied methods. A method to construct the modular drilling entails transporting numerous standardized transfigurable shipping containers with drilling equipment to a drilling location. The standardized transfigurable shipping containers with the drilling equipment are unfolded at the drilling location. Two or more of the unfolded transfigurable containers are connected together to form operable drilling equipment and an operable drilling rig. Typically, as shown in FIG. 9, the drilling equipment includes a control cabin (30), a drawworks (32), a BOP control unit (38), a rotary table (46), various pumps (48*a* and 48*b*), solids control equipment (50*a*, 50*b*, and 50*c*), power sources (52*a* and 52*b*), hydraulic power units (54*a*, and 54*b*), a tank (56), electrical control equipment (58), a pipe rack (60), a mud pit (100), an active mud tank (102), and other such equipment. The connected equipment is erected with piping (78, 80, and 82) and cabling (84, 86, and 88) for communication and power cabling for complete operation.

Figure 10:
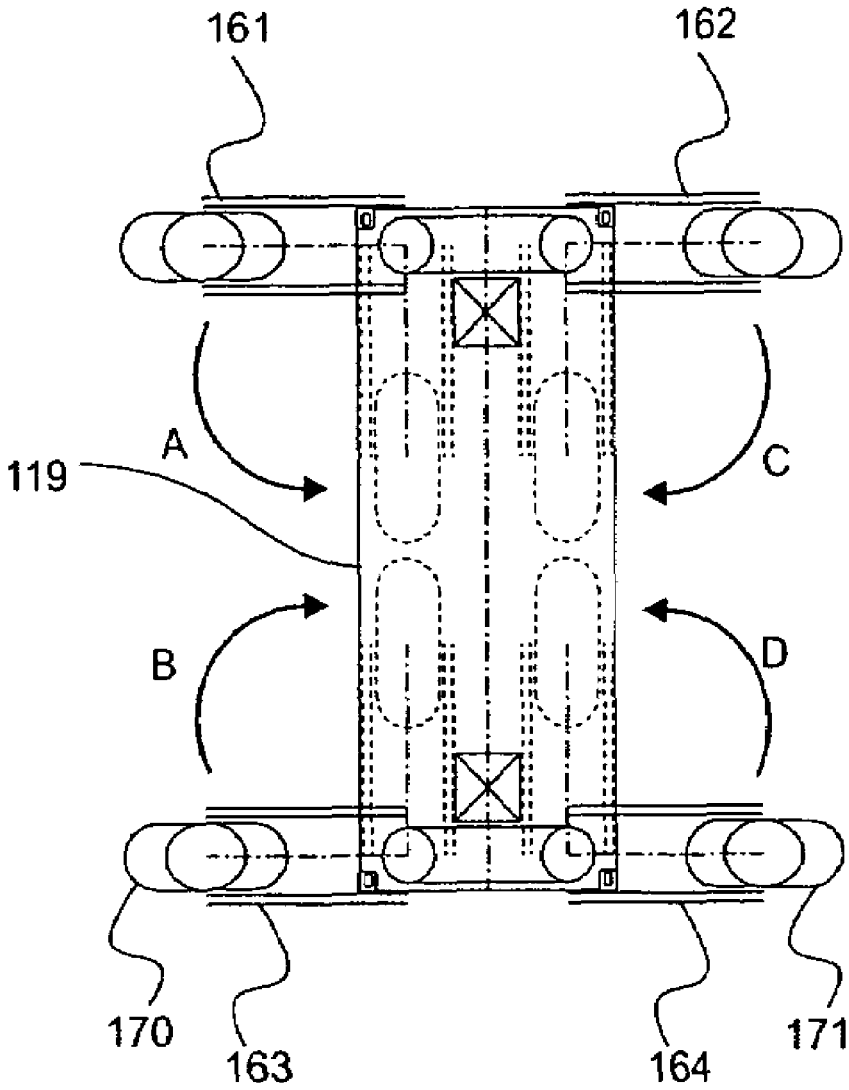
FIG. 10 depicts a top view of a straddle carrier and the manner of folding according to the embodied methods.

FIG. 10 depicts a top view of a containerized straddle carrier (119) and the manner of folding according to the embodied methods. The straddle carrier (119) comprises four wheels (two are identified, 170 and 171) that are movably attached to a frame (161, 162, 163, and 164). The lifting section of the frame is fixably connected to a support section of the frame. The support section of the frame is of the size of a standard size shipping container, preferably an ISO standardized container. The spreader section of the frame is temporarily to the support section. The spreader section connects to the load to be lifted. The lifting section can move the support section in a vertical direction to pick up loads from and to container carriers. The wheels (two are identified, 170 and 171) can be folded upwards when the straddle carrier "transforms" to a transportable size. The folding direction of the wheels (two are identified, 170 and 171) is depicted in FIG. 11 by the arrows (A, B, C, and D).

Figure 11A:
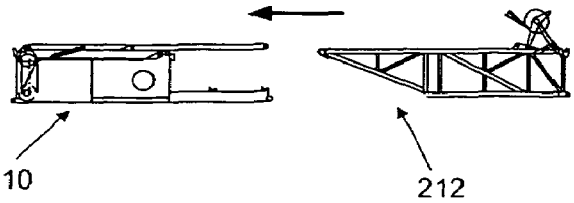
FIGS. 11*a* through 11*e* example a rig up sequence showing the erection of the drilling derrick or mast.
Figure 11B:
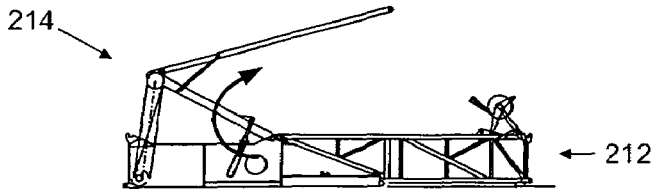
Figure 11C:
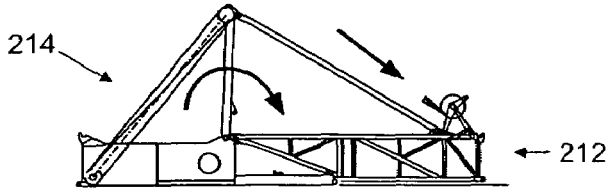
Figure 11D:
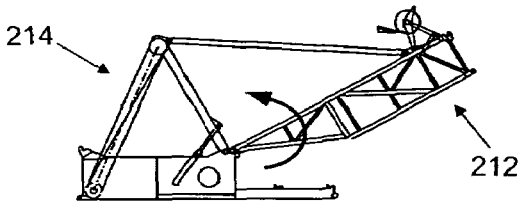
Figure 11E:
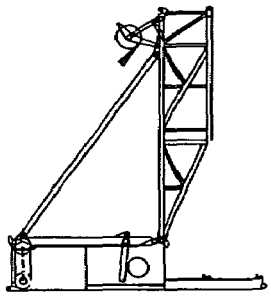

FIGS. 11*a* though 11*e* example an embodiment of a rig up procedure for the embodied drilling rig. The procedure begins by moving two transfigurable containers together (210 and 212). FIGS. 11*a* though 11*e* example a base container (210) and a mast or derrick container (212). After the containers are connected, hoisting means (214), which are part of base container (210), are rotated out towards the mast or derrick container (212) and then connected to the mast or derrick container (212). The mast container (212) is rotated into vertical position and finally locked in place.

Figure 12A:
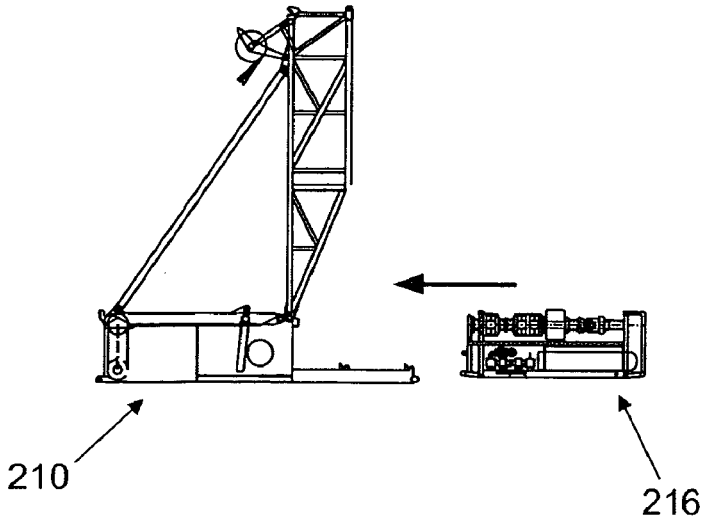
FIGS. 12*a* through 12*c* example a rig up sequence involving a BOP container.
Figure 12B:
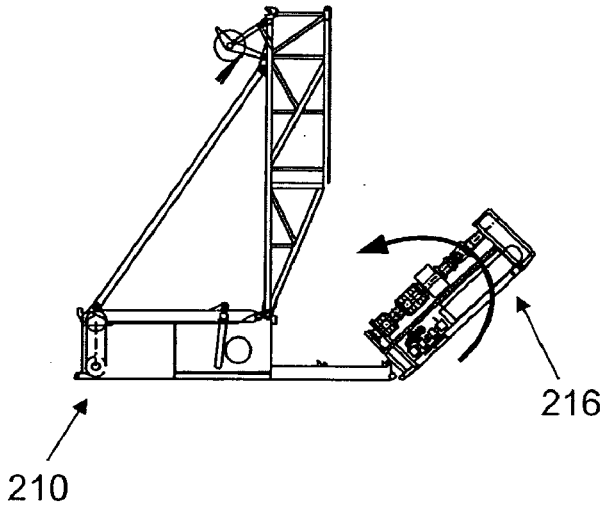
Figure 12C:
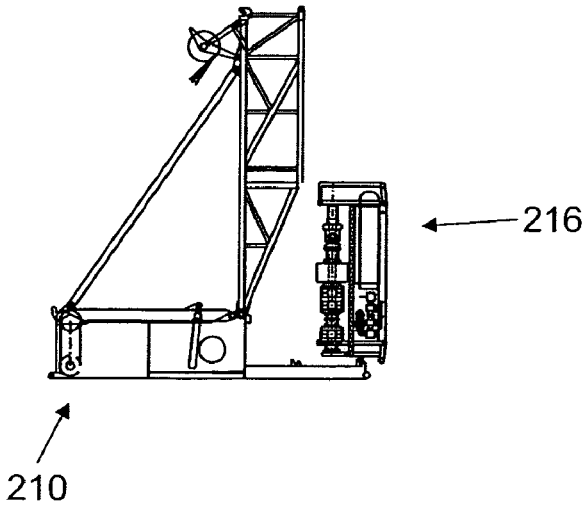

FIGS. 12*a* through 12*c* example a rig up sequence involving a BOP container (216). The BOP container (216) is moved towards base container (210) and connected to base container (210). After connection is complete, the BOP container (216) is rotated into vertical position. The rotation can be done using various hoisting means (not shown). The BOP container (216) with the drill floor is locked firmly in place with the other containers.

Figure 13:
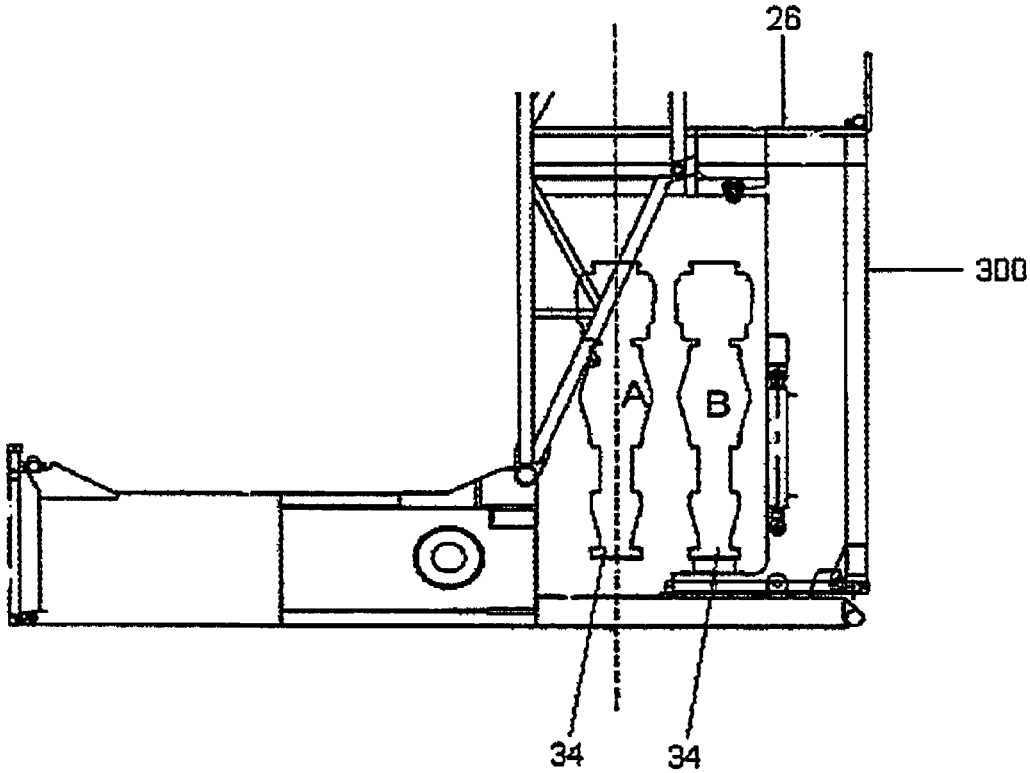
FIG. 13 depicts a side view of the BOP container in assembled condition.

FIG. 13 depicts a side view of the drill floor and the BOP container as assembled in FIG. 11*a* through 12*c*. The BOP Is located inside the BOP container during transport. During operations, the BOP is moved from the storage and testing position inside the container space to a position directly in the firing line of the drilling rig. The BOP (34) can be tested while in storage position, thereby providing a benefit during rig-up because the SOP testing is no longer in the critical path. Further, as shown in FIG. 13, a part of the drill floor (26) can be part of the SOP container. As exampled in FIG. 13, a side connector plate (300) can be connected to the standard oilfield connectors to convert the container to an ISO standard container. An overhanging crane moves the BOP from storage to firing line position, but other crane and moving arrangements can be used as well.

The embodiments have been described in detail with particular reference to certain preferred embodiments thereof, but it will be understood that variations and modifications can be effected within the scope of the embodiments, especially to those skilled in the art.

What is claimed is:

1. A modular transfigurable drilling rig comprising:

a. at least two transfigurable containers removable from a transport device selected from the group consisting of: a first transfigurable container forming a substructure, a second transfigurable container forming a mast, a third transfigurable container forming a pipehandler, a fourth transfigurable container forming a mud pump container, and a fifth transfigurable container forming a drawworks, wherein the transfigurable containers are adapted to form an operational drilling rig, and wherein the transfigurable container comprises:

i. a load bearing structure comprising a first load bearing support, a second load bearing support, and a load bearing bottom, wherein the load bearing bottom is disposed between the first and the second load bearing supports, thereby forming a space; and ii. drilling equipment connected to the load bearing structure, iii. a connector adapted to engage at least two transfigurable containers;

b. piping adapted to connect the drilling equipment together;

c. cabling adapted to provide communication between the drilling equipment; and d. a power source connected to the drilling equipment, wherein the power source is adapted to provide power to the drilling equipment.

2. The modular transfigurable drilling rig of claim 1, wherein the drilling equipment is movable between a first position disposed within the space and a second position disposed outside the space.

3. The modular transfigurable drilling rig of claim 1, wherein the transfigurable container further comprises a blow out preventer and a second transfigurable container comprises a mast substructure.

4. The modular transfigurable drilling rig of claim 1, further comprising a crane, wherein the crane is mounted on top of a mast or derrick and is used to construct the modular transfigurable drilling rig.

5. The modular transfigurable drilling rig of claim 4, wherein the crane is remotely controlled.

6. The modular transfigurable drilling rig of claim 4, wherein the crane folds inside a second transfigurable container.

7. The modular transfigurable drilling rig of claim 1, wherein the modular transfigurable drilling rig is configured for use as a land based oil drilling rig or natural gas drilling rig.

8. The modular transfigurable drilling rig of claim 1, wherein the modular transfigurable drilling rig is configured for use on a semi-submersible, a tension leg platform, a jack up platform, a floating vessel, or combinations thereof.

9. The modular transfigurable drilling rig of claim 1, wherein the modular transfigurable drilling rig is configured for use on a fixed oilfield offshore platform, wherein the fixed oilfield offshore platform is selected from the group consisting of a jacket, a production platform, a compliant tower platform, and a platform supported by a seabed.

10. The modular transfigurable drilling rig of claim 1, wherein the connector is a load bearing device.

11. The modular transfigurable drilling rig of claim 10, wherein the load bearing device is selected from the group consisting of a pin, a hydraulic clamp, a mechanical clamp, a threaded connector, a male and female receptacle, and combinations thereof.

12. The modular transfigurable drilling rig of claim 1, wherein the connector is a non-load bearing device.

13. The modular transfigurable drilling rig of claim 12, wherein the non-load bearing device is selected from the group consisting of a threaded connector, a plug, a hydraulic clamp, a mechanical clamp, a pin, a male and female receptacle, and combinations thereof.

14. The modular transfigurable drilling rig of claim 1, wherein the modular transfigurable drilling rig is partially formed from transfigurable containers and other drilling equipment.

15. The modular transfigurable drilling rig of claim 1, wherein the transfigurable container is a containerized straddle carrier adapted to fold inside a standard shipping container and to be transported as the standard shipping container.

16. The modular transfigurable drilling rig of claim 1, wherein the modular transfigurable drilling rig is a transfigurable container.

17. The modular transfigurable drilling rig of claim 1, wherein the modular transfigurable drilling rig comprises a footprint less than 1400 square meters.

18. The modular transfigurable drilling rig of claim 1, wherein the modular transfigurable drilling rig comprises a rig-move time less than 30 hours.

19. The modular transfigurable drilling rig of claim 1, wherein the drilling equipment comprises mud processing equipment, and wherein the mud processing equipment comprises a shaker and a mud storage tank.

20. The modular transfigurable drilling rig or claim 19, wherein the shaker is disposed inside the mud storage tank during transport and above the mud storage tank during use.

21. The modular transfigurable drilling rig of claim 1, wherein the transfigurable container further comprises a BOP, wherein the BOP is tested while inside the space.

* * * * *